US005383632A

United States Patent [19]

Shirlin et al.

[11] Patent Number: 5,383,632

[45] Date of Patent: Jan. 24, 1995

[54] MOVEABLE FOREARM AND WRIST SUPPORT

[76] Inventors: Jack W. Shirlin, 31706 Sheridan, Garden City, Mich. 48135; Robert T. Kaiser, 32916 Avondale, Westland, Mich. 48185

[21] Appl. No.: 109,838

[22] Filed: Aug. 20, 1993

[51] Int. Cl.[6] ..... B43L 15/00

[52] U.S. Cl. ..... 248/118.5; 400/715

[58] Field of Search ..... 248/118, 118.1, 118.3, 248/118.5, 278; 400/715, 489

[56] References Cited

U.S. PATENT DOCUMENTS

| | | | |
|---|---|---|---|
| 2,477,898 | 8/1949 | Rehman et al. | 248/118 |
| 2,766,463 | 10/1956 | Bendersky | 248/118 |
| 4,069,995 | 1/1978 | Miller | 248/118.1 |
| 5,056,743 | 10/1991 | Zwar et al. | 248/118 |
| 5,072,905 | 12/1991 | Hyatt | 248/118 |
| 5,074,501 | 12/1991 | Hölttä248 | 118.3/ |
| 5,108,057 | 4/1992 | Dandy, III et al. | 248/118 |
| 5,135,190 | 8/1992 | Wilson | 248/118.1 |
| 5,147,090 | 9/1992 | Mandell et al. | 248/118.1 |
| 5,158,256 | 10/1992 | Gross | 248/118.3 |
| 5,161,760 | 11/1992 | Terbrack | 248/118 |

*Primary Examiner*—Ramon O. Ramirez
*Attorney, Agent, or Firm*—Charles W. Chandler

[57] ABSTRACT

A support for the wrists and forearms of a user performing manual tasks, such as operating a keyboard, assembling small parts and the like, includes a rectangular flat work-supporting frame and a pair of arms pivotally mounted on the frame. An elongated cushioned forearm and wrist support is mounted on the outer end of each arm to support the user's forearms and wrists so that the fingers can be used to perform a manual task.

9 Claims, 3 Drawing Sheets

MOVEABLE FOREARM AND WRIST SUPPORT

BACKGROUND OF THE INVENTION

This invention is related to a moveable wrist and forearm support for a user performing manual tasks such as using a computer keyboard, or assembling small parts and the like, in which her forearms are supported in a horizontal positions.

Many workers such as keyboard operators, and workers performing small part assembly and the like, have each upper arm in a generally vertical position, and each lower forearm and hand held in a lower horizontal position in front of their body. Over a period of time, the unsupported forearms and hands create a stress in the muscles of the shoulders and the neck. The resulting fatigue impairs the performance of the worker.

When the workers are performing a repetitive task such as on a keyboard, a widespread disorder known as Carpel Tunnel Syndrome is common. The user adjusts her chair height so that she can hold her forearms in a horizontal position with her wrists and hands forming a horizontal extension of her forearms. However, when the user maintains this position for several hours, she tends to rest her hands on the edge of the keyboard or the table to relieve the stress on her upper arms and neck. In order to reach the keys on the keyboard, each hand must be tilted upwardly from the wrist. This abnormal position then strains the tendons and nerves in the wrist area.

Some devices are known in the prior art for providing relief to such users. For example, U.S. Pat. No. 5,147,090 which was issued Sep. 15, 1992 to Sandra Mandell and Madge W. Wiest; and U.S. Pat. No. 5,072,905 which was issued Dec. 17, 1991 to Robert G. Hyatt provide an individual arm rest that extends from the position where the operator is manipulating the keyboard. However, the arm rest will not freely move with the user's arm. For example, she may want to move her left arm to reach a telephone, or move her right arm around the keyboard in order to reach a "mouse" for use with the computer. Further, they do not readily accommodate the specific physical configuration of the user.

U.S. Pat. No. 5,161,760 which was issued Nov. 10, 1992 to William H. Terbrack shows a support in which the user rests her wrists on a pair of padded wrist supports. The wrist supports do not provide ample support for substantially the full length of the user's forearm. She has to rest the weight of her arm on the wrist supports.

U.S. Pat. No. 2,477,898 which was issued to Irving Rehman and Kay D. Crawford on Aug. 2, 1949 discloses an arm rest for a manicurist table or a barber chair. The arm rest swings about a pair of pivots and supports the user's arm so the manicurist can work on the fingers.

U.S. Pat. No. 5,135,190 which was issued to Robert W. Wilson on Aug. 4, 1992 discloses an articulating support apparatus.

U.S. Pat. No. 5,158,256 which was issued Oct. 27, 1992 to Biomechanics Corporation of America, discloses a pad support for the wrist of a keyboard operator.

SUMMARY OF THE INVENTION

The broad purpose of the present invention is to provide an improved wrist and forearm support for a seated user who holds her forearm and hand in a horizontal position in front of her body to perform a manipulative task.

The preferred embodiment of the invention employs a portable rectangular work-supporting frame that may be placed on a work-table. The frame could constitute a worktable. A computer or other device is mounted on top of the frame. A pair of thin, relatively flat arms have their inner ends pivotally connected inside the frame. The outer arm ends extend beyond the forward edge of the frames toward the user. The two arms are flat and have a boomerang-shaped configuration so that the outer ends can be swung beyond the side edges of the frame. The two arms are each slideably supported on Teflon low-friction sheets mounted in the frame so that they can swing independently in a very smooth motion.

A pair of elongated, cushioned arm rests are pivotally mounted on the outer ends of the two arms. Each arm rest has a length of about 10 inches so that the upper surface of the arm rest engages substantially the full length of the user's forearm. The forward end of each arm rest may be swung adjacent the frame so the user's wrist and hand are supported as a generally horizontal extension of her forearm, with the fingers adjacent the location of the keys on the keyboard or the like. The arrangement is such that the two arm rests are independently swingable to accommodate the particular configuration of the user. They provide full support for the user's wrist and forearm so that she not only can rest her weight on the arm rest but, in addition, maintain her wrist and forearm in a proper horizontal attitude.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
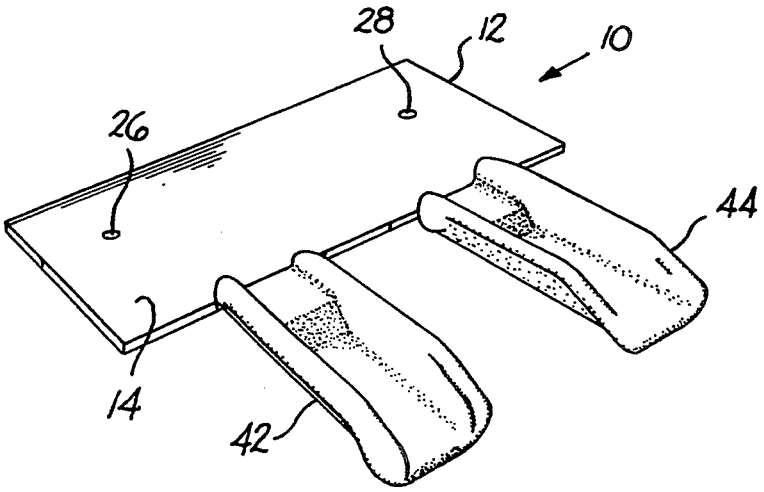
FIG. 1 is a perspective view of a wrist and forearm support illustrating the preferred embodiment of the invention.

Referring to the drawings, a preferred wrist and forearm support comprises a flat frame 12. Frame 12 is portable and can be mounted on a suitable worktable, not shown. The invention could also be built-in a worktable or the like having a horizontal top working surface. Frame 12 is relatively thin, having a rectangular configuration with a length of about 19¾" and a width of 8¾". The body of the frame comprises an upper wooden panel 14, a lower wooden panel 16 and a pair of wooden spacers 18 and 20 between two panels. The upper panel, the lower panel and the spacers each have a thickness of about ¼". The upper and lower panels are attached by any suitable means to the spacers to form a frame having an overall thickness of about ¾". The panels and spacers could be made of other suitable materials such as metal or plastic.

A pair of boomerang-shaped, steel arms 22 and 24 have their inner ends connected by horizontal pivot means 26 and 28 to the upper and lower panels so the inner arm ends overlap the frame. The outer arm ends overhang the frame's front edge. The two pivots are located about 15" apart and 3" from the far edge of the frame. The two arms are relatively thin, having a thickness of 3/16".

Figure 3:
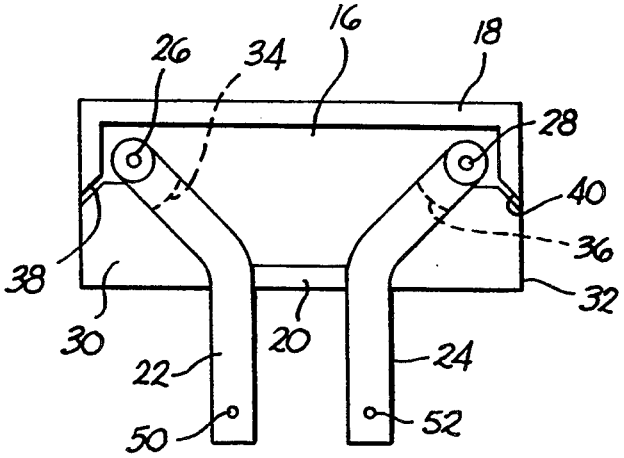
FIG. 3 illustrates the supporting frame with the top frame panel and the cushions removed.
Figure 4:
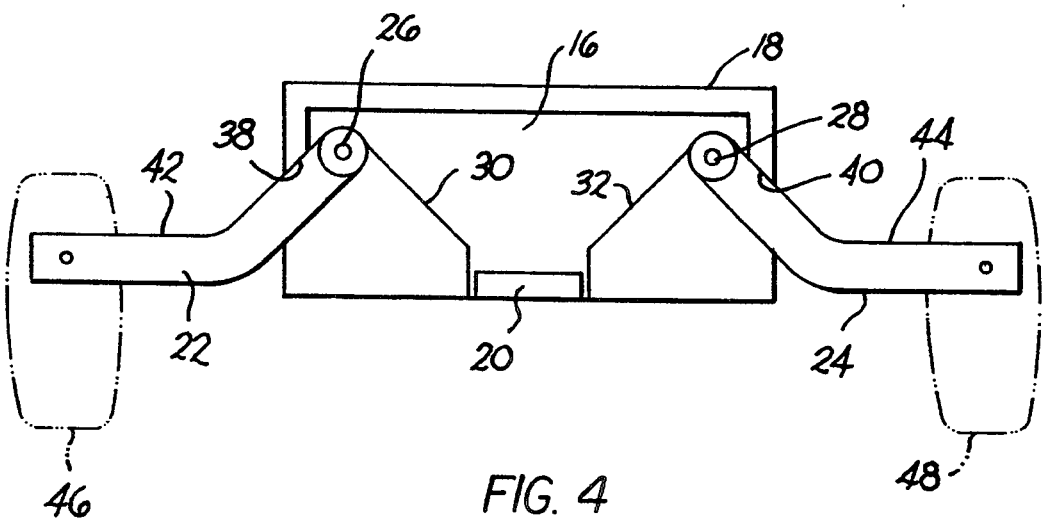
FIG. 4 is a view similar to FIG. 3 but in which the two arms have been swung to their outermost positions.

The two arms are supported on sheets of Teflon low friction material 30 and 32, respectively, which are mounted on the lower panel and have a length and width sufficient to slideably support the two arms in their full path of motion from their inner positions illustrated in FIG. 3 to their outer positions illustrated in FIG. 4. The two Teflon sheets form a low friction surface for the two arms. Other low friction sheet materials may be used or even a flat well greased surface.

Arm 22 carries a short sheet of low friction material 34 on its underside slideably engaging sheet 30, while arm 24 has a short sheet of low friction material 36 on it's underside slideably engaging sheet 32.

Spacer 20 has a length of about 3". The ends of the spacer provide a stop structure for the two arms, as illustrated in FIG. 3, as they are swung toward one another to define their respective inner most positions.

U-shaped spacer 18 has ends 38 and 40 providing a stop structure for arms 22 and 24, respectively, as they are swung away, one from the other, toward their outermost positions, as shown in FIG. 4. The boomerang-shaped configuration of the two arms provides concave edges 42 and 44, respectively, that permit the outer ends of the arms to swing around spacer ends 38 and 40, an appreciable distance beyond the side edges of the frame structure. Spacer ends 38 and 40 could be lengthened or shorten to reduce or increase the arc of motion of the two arms. For illustrative purposes, each arm is swingable in an arc of about 90° as shown in FIG. 3 and with respect to its innermost and outermost positions.

A pair of elongated cushioned arm rests 46 and 48 are mounted on the outer ends of arms 22 and 24 respectively. The two arm rests are identical, each having a length of about 10". The two arm rests are pivotally mounted on pivot means 50 and 52. Pivot means 50 and 52 can be swung around spacer ends 38 and 40 as the arms are moved toward their outermost positions.

Figure 2:
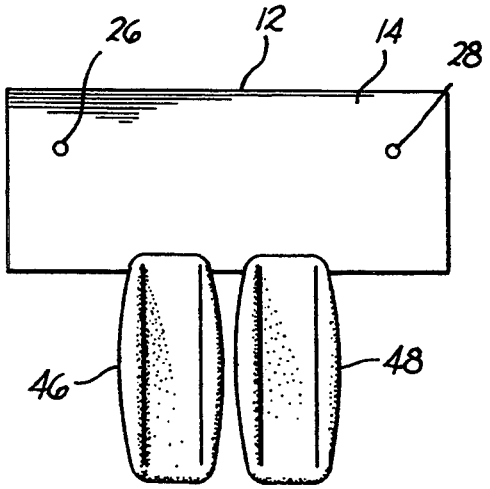
FIG. 2 is a plan view of the preferred wrist and forearm support.
Figure 6:
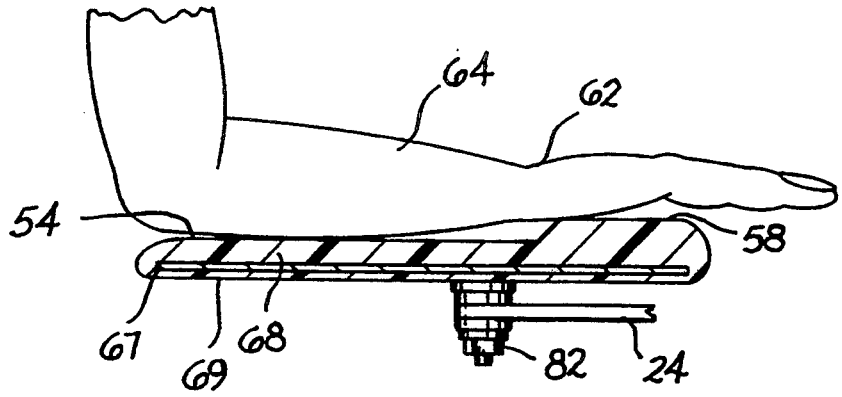
FIGS. 6 and 7 show the user's wrist and forearm resting on the support.
Figure 7:
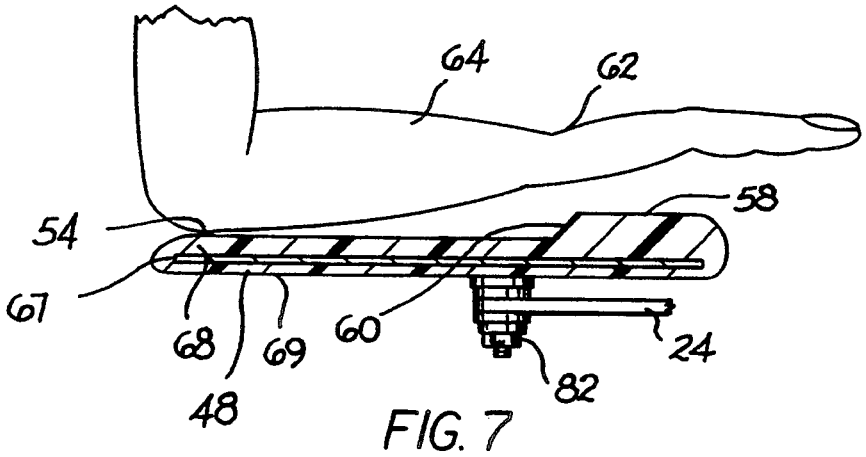
Figure 8:
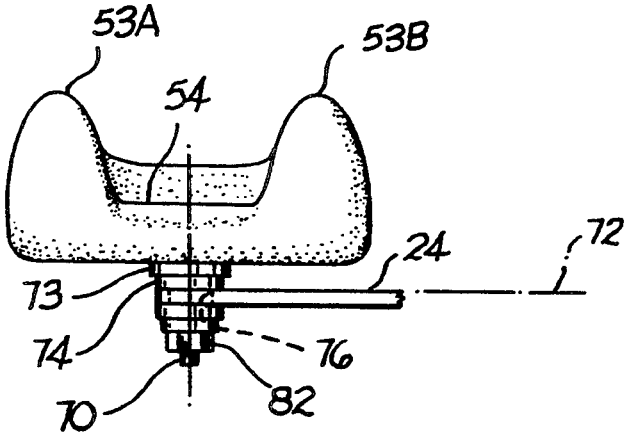
FIG. 8 is an end view of one of the cushioned arm rests.

Referring to FIGS. 2 and 8, the two cushioned arm rests each have a generally channel-shaped cross-section, including a pair of cushioned sides 53A and 53B. FIGS. 6 and 7 show a longitudinal cross section of a typical arm rest. The upward-facing surface of bottom 54 has a forward raised end 58 with an inclined section 60. Raised end 58 is intended to support the wrist 62 of a user. The height of inclined section 60 is adapted to accommodate the enlarged forearm 64 of the user resting her arm and wrist on the arm rest.

Figure 5:
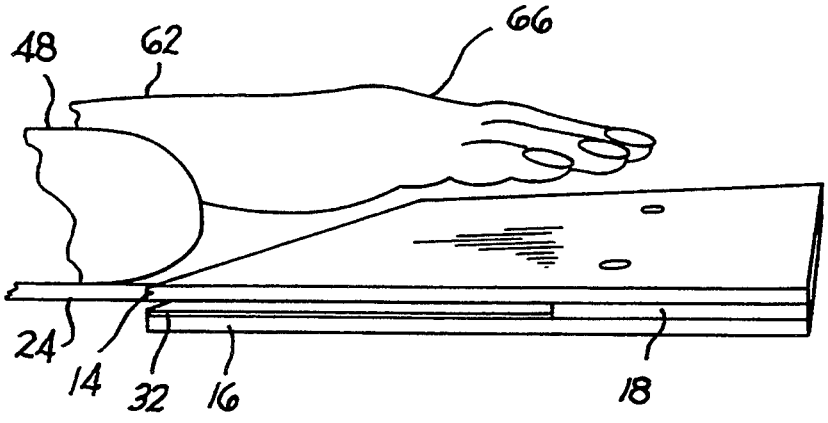
FIG. 5 is a view illustrating the position of the user's hand when supported on the arm rest.

The length of each arm rest is such that it extends adjacent the user's elbow to support substantially the full length of the user's forearm. Each arm rest, when disposed as illustrated in FIGS. 2 and 5, supports the user's wrist 62 such that her hand 66 may be comfortably held as a horizontal extension of her forearm in a position adjacent the location of the device being manipulated, such as the keys of a keyboard. The user can easily raise her wrist while her forearm remains supported on the arm rest as illustrated in FIG. 7, because of the length of the arm rest.

The two arm rests are individually swingable to adjusted positions, depending upon the particular configuration of the user. They can be fully extended to the positions illustrated in phantom in FIG. 4 in which the arm rests extend outwardly from the side edges of the frame.

Each arm rest has an inner hard core 67 with a layer of compressible plastic foam 68, and an outer cover 69.

Referring to FIG. 8, a typical arm rest pivot means comprises a threaded pivot stud 70 supporting arm rest 48 for pivotal motion in a plane 72 which is parallel to the top of a plane containing the top surface of low friction sheets 30 and 32, and the plane containing the top surface of upper panel 14. Stud 70 is received in a thrust washer bearing 73 which is seated on T-shaped bushing 74. Bushing 74 is seated in opening 76 in arm 24. A thrust washer bearing 78 and a thrust washer 80 are clamped beneath arm 24 by lock nut 82.

In their outermost positions, the longitudinal axis of the two arm rests can be disposed parallel and beyond the side edges of the frame.

The frame can either be built into a worktable or can be portable and connected to a work station, such as a computer table, by means such as suction cups, Velcro fasteners, an adhesive or other suitable means.

Having described our invention, we claim:

1. A wrist and forearm support device, comprising:

a frame having a front edge supported in front of the user, a side edge, the frame having a generally upward-facing surface suited for supporting a hand-operated device such as a keyboard;

a first arm having a first end overlapping the front edge of the frame, and an opposite end overhanging the front edge of the frame in a first arm position;

first pivot means connecting the first end of the first arm to the frame such that the first arm is swingable about the first pivot means in a generally horizontal plane toward a second arm position in which said opposite end of the first arm overhangs said side edge;

a first elongated cushioned arm rest having a longitudinal axis and an upward-facing cushioned surface, and second pivot means on the overhanging end of the first arm and beneath the first cushioned arm rest for supporting the first cushioned arm rest for a pivotal motion in a generally horizontal position about an axis generally normal to said horizontal plane, the first cushioned arm rest having a length sufficient to cradle the user's wrist and a major portion of the forearm between the wrist and the elbow, wherein the user can rest her arm on the cushioned arm rest when it is disposed in a selected position with respect to the frame; and the cushioned arm rest being swingable between a first position, generally normal to said front edge, when said opposite end of said first arm is disposed in said first arm position, and a second position in which the longitudinal axis of the arm rest is parallel to the side edge and spaced outwardly therefrom, and said opposite end of said first arm is disposed in said second arm position.

2. A device as defined in claim 1, including stop means on the frame for permitting swinging motion of the first arm about the first pivot means in an arc of about 90°.

3. A device as defined in claim 1, including a second arm having a first end overlapping the frame and an opposite end overhanging the frame, pivot means for connecting the first overlapping end of the second arm to the frame for swinging motion in the horizontal plane containing the path of motion of the first arm, a second elongated cushioned arm rest, and pivot means on the second arm for supporting the second elongated cushioned arm rest for pivotal motion in a generally horizontal position about an axis generally normal to said horizontal plane, the second cushioned arm rest having a length sufficient to cradle the user's companion wrist and forearm, whereby the user can rest her companion arm on the second cushioned arm rest when it is disposed in a selected position with respect to the frame, independently of the position of the first mentioned arm rest.

4. A device as defined in claim 1, in which the cushioned arm rest is elongated, has a generally channel-shaped configuration, and includes a first end and a second end, the first end having an upwardly facing surface inclined toward the second end to support the user's wrist in a horizontal extension of her forearm.

5. A device as defined in claim 1, in which the frame has a stop structure located on the frame, the arm has a concave edge for engaging the stop structure such that the arm can be swung to an extreme position toward the stop structure in a motion in which the second pivot means on the arm swings around the stop structure.

6. A device as defined in claim 1, in which the frame includes a top planar surface for supporting a working device, the top supporting surface being disposed generally parallel to said horizontal plane.

7. A wrist and forearm support device, comprising:

a frame having a front edge supported in front of the user, and a side edge the frame having a generally upward-facing surface suited for supporting a hand-operated device such as a keyboard;

an arm having a first end overlapping the front edge of the frame, and an opposite end overhanging the front edge of the frame in a first arm position;

the arm having a generally planar bottom surface, and including a low-friction planar surface on the frame beneath the arm for slideably supporting the arm toward a second position in which said opposite end of the first arm overhangs said side edge;

first pivot means connecting the first end of the arm to the frame such that the arm is swingable about the first pivot means in a generally horizontal plane;

a first elongated cushioned arm rest having a longitudinal axis and an upward-facing cushioned surface, and second pivot means on the overhanging end of the arm and beneath the first cushioned arm rest for supporting the first cushioned arm rest for a pivotal motion in a generally horizontal position about an axis generally normal to said horizontal plane, the first cushioned arm rest having a length sufficient to cradle the user's wrist and a major portion of the forearm between the wrist and the elbow, wherein the user can rest her arm on the cushioned arm rest when it is disposed in a selected position with respect to the frame; and the first cushioned arm rest being swingable between a first position, generally normal to said front edge, when said opposite end of said first arm is disposed in said first arm position, and a second position in which the longitudinal axis of the arm rest is parallel to the side edge and spaced outwardly therefrom, and said opposite end of said first arm is disposed in said second arm position.

8. A device as defined in claim 7, in which the low-friction surface comprises a sheet of Teflon low-friction material, the Teflon sheet being disposed between the first pivot means and the front edge of the frame.

9. A wrist and forearm support device for supporting a user's left and right wrists and forearms in generally horizontally adjusted positions, comprising:

a frame having a front edge, the frame being adapted to be placed in front of the user with the front edge facing the user, and the frame being suited for supporting a workpiece that is to be manipulated by the user's hands, such as a keyboard;

a first arm, and first pivot means disposed on the frame rearward of the front edge for supporting the first arm for motion parallel to a generally horizontal plane;

a second arm, and second pivot means disposed on the frame rearward of the front edge for supporting the second arm for motion parallel to said generally horizontal plane either toward or away from the first arm;

a first elongated cushioned arm rest having an upward facing cushioned surface, and pivot means on the first arm supporting the first cusioned arm rest for a pivotal motion about an axis generally normal to said horizontal plane, the first cushioned arm rest having a length sufficient to cradle the user's right wrist and a major portion of the attached forearm between the wrist and the elbow, wherein the user can rest her right arm on the first cushioned arm rest in a selected position with respect to the frame;

a second elongated cushioned arm rest having an upward facing cushioned surface, and pivot means on the second arm supporting the second cushioned arm rest for a pivotal motion about an axis generally normal to said horizontal plane, the second cushioned arm rest having a length sufficient to cradle the user's left wrist and a major potion of the attached forearm between the wrist and the elbow, whereby the user can rest her left arm on the second cushioned arm rest in a selected position with respect to the frame, and the first arm rest;

said first and second arms having a generally planar bottom surface, and including low-friction planar surface means on the frame beneath the path of motion of the first and second arms for slideably supporting said arms; and said first and second arm rests each being swingable with their respective arms between a first position, generally normal to said front edge, and a second position spaced outwardly on opposite sides of the frame.

* * * * *